United States Patent [19]

Clark et al.

[11] 4,432,107

[45] Feb. 21, 1984

[54] NECK SUPPORT REST

[76] Inventors: Robert F. Clark, 180 George St., Rockwood, Ontario, Canada, N0B 2K0; Hugh A. Smythe, 2 Heathbridge Park Rd., Toronto, Ontario, Canada, M4G 2Y6

[21] Appl. No.: 307,639

[22] Filed: Oct. 1, 1981

[30] Foreign Application Priority Data

Oct. 7, 1980 [GB] United Kingdom ..... 8032331

[51] Int. Cl.[3] ..... A47G 9/00

[52] U.S. Cl. ..... 5/436; 5/434

[58] Field of Search ..... 5/434, 435, 436, 437, 5/438, 439, 440, 441; D6/201

[56] References Cited

U.S. PATENT DOCUMENTS

| | | | |
|---|---|---|---|
| D. 203,251 | 12/1965 | Barber | D6/201 |
| 2,880,428 | 4/1959 | Forsland | 5/436 |
| 2,896,227 | 7/1959 | Reed | 5/441 |
| 3,035,279 | 5/1962 | Stead | 5/436 |
| 3,753,264 | 8/1973 | Grenier | 5/436 |
| 4,218,792 | 8/1980 | Kogan | 5/436 |

*Primary Examiner*—Alexander Grosz

*Attorney, Agent, or Firm*—Sim & McBurney

[57] ABSTRACT

There is provided a neck support rest comprising a unitary body of resilient material, the body having a base portion with top and bottom surfaces, a rear edge and a front edge, and an upstanding ridge along the front edge. The top of the ridge overhangs the bottom of the ridge in order to ensure that the ridge can tuck into and hence support the lower neck region of a person lying on his side with his head on the base portion.

5 Claims, 7 Drawing Figures

NECK SUPPORT REST

This inventon relates generally to a neck support rest which has upper and lower regions and which lends itself to the support of the neck and head of a person in a reclining position.

BACKGROUND OF THIS INVENTION

It has been the custom for many years when persons have had neck and back ailments to give support to the head when the person is in a reclining position. In many cases such support has not satisfactorily relieved the ailment. It has been found that the ailment has been alleviated by supporting the neck. This neck support rest provides support to the neck while also supporting the head.

Exemplary of the prior art pertinent to this invention are U.S. Pat. No. 2,880,428, issued Apr. 7, 1959 to A. C. Forsland, and U.S. Pat. No. 3,753,264, issued Aug. 21, 1973 to G. A. Grenier. Both of these prior patents disclose an embodiment of pillow-support in which a rearward portion adapted to support the head is at a lower elevation than a forward portion adapted to lodge under and support the neck of the user.

However, in the case of both of these prior patents, there are certain disadvantages to the configurations selected by the patentees, which relate particularly to what happens when a person attempts to sleep on his side. It is well known that many individuals prefer to sleep on their sides, being unable to breathe properly in any other position. A difficulty inherent in both of the prior patents relates to the fact that the forward neck-supporting ridge portion of the item is not configured in such a way as to be supple or yielding enough to allow the user to use the item both when lying on the back and when when lying on his side. A further problem, particularly exemplified by U.S. Pat. No. 3,753,264, relates to the fact that the generally rearward slope of the upstanding ridge portion intended to lodge under the neck of the user tends, upon compression by the weight of the neck and head of the user, to shift or to seek to shift toward the rear (i.e. toward the crown of the head). This in effect places compressive pressure between the neck and head, and in a sense tends to push the neck surface toward the head. However, many persons suffer from tenseness and internal contraction of muscles and other tissues in the neck and lower head, so that a pillow item which seeks to increase that tension and compression would not be productive of comfort when sleeping.

GENERAL DESCRIPTION OF THIS INVENTION

Accordingly, it is an aspect of this invention to provide a neck and head supporting item or pillow which is configured in such a way as to be able to resiliently support the neck and the head of the user whether in a supine position or in a side position during sleep.

It is a further aspect of this invention to provide a neck and head supporting cushion item which is capable, during use, of exerting a slight traction effect on the neck and head regions.

Finally, it is a further aspect of this invention to provide a head and neck supporting cushion which is configured in such a way as to ensure that the neck supporting portion can lodge well down along the neck, regardless of the position of the lower shoulder. Hence, full support of the neck region is assured.

Accordingly, this invention provides a neck support rest comprising a unitary body of resilient material. The body has a base portion with top and bottom surfaces, a rear edge and a front edge, and an upstanding ridge along the front edge. The top of the ridge overhangs the bottom of the ridge in order to ensure that the ridge can tuck into and hence support the lower neck region of the person lying on his side with his head on the base portion.

GENERAL DESCRIPTION OF THE DRAWINGS

Three embodiments of this invention are illustrated in the accompanying drawings, in which like numerals denote like parts throughout the several views, and in which.

DETAILED DESCRIPTION OF THE DRAWINGS

Figure 1:
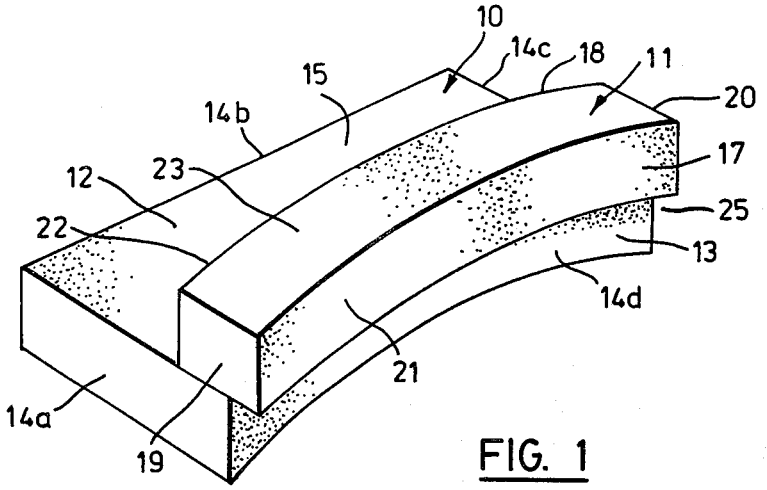
FIG. 1 is a perspective view of one embodiment of the support rest of this invention.
Figure 2:
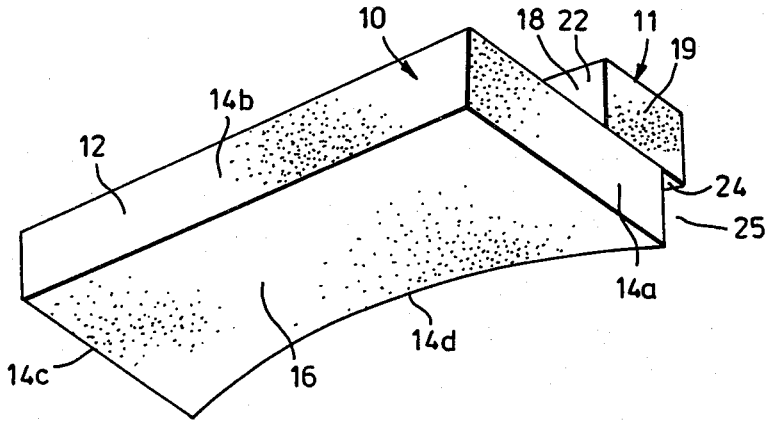
FIG. 2 is a perspective view of the support rest of FIG. 1, seen from underneath.
Figure 3:
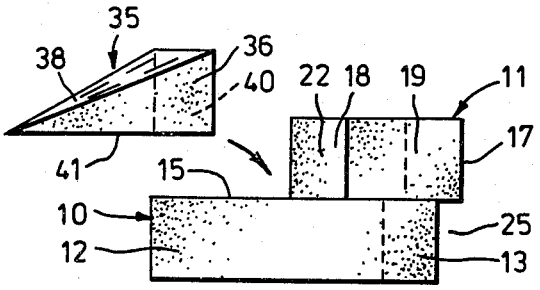
FIG. 3 is an elevational view of the first embodiment of this invention.

Reference is now made to FIGS. 1, 2 and 3 of the drawings, showing a support rest which has a lower region or base 10 and an upper region or ridge 11. It is to be understood that base 10 and ridge 11 can be formed separately and subsequently attached to form the neck support rest or can be molded in one piece in the shape shown in the figures and hereafter described to form the neck support rest.

The base 10 is of rectangular plan at its rear portion 12, of uniform thickness and concavely inwardly arched at its front portion 13. It has walls 14*a*; 14*b* and 14*c*, arched wall 14*d*, upper surface 15 and lower surface 16.

The ridge 11 is situated on the upper surface 15 at the forepart of the base 10 and is arched as is the base 10 at its front portion 13. Further the ridge 11 is arched along both its front portion 17 and its rear portion 18. The ridge 11 has side walls 19 and 20, a front arched wall 21, a rear arched wall 22, upper surface 23 and lower surface 24.

The ridge 11 protrudes lengthwise over the front portion 13 of base 10 such that a recess 25 is defined beneath ridge 11.

Figure 4:
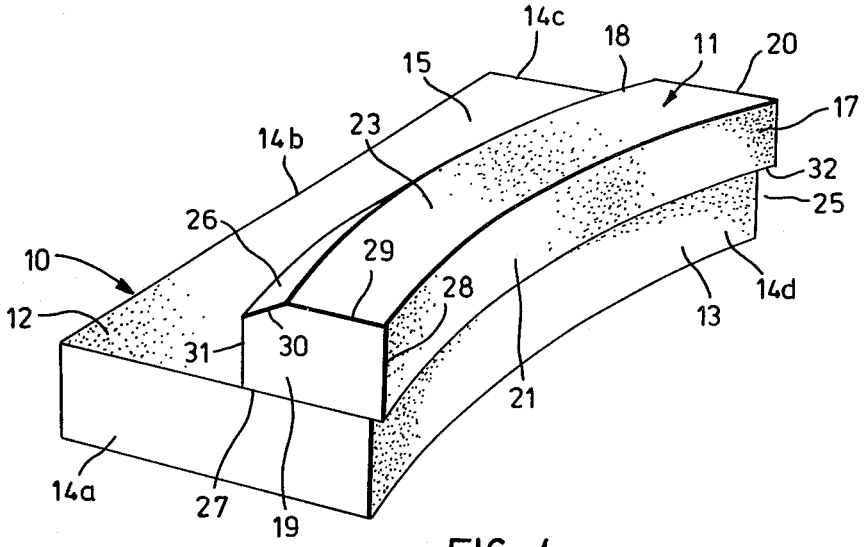
FIG. 4 is a perspective view of the second embodiment of the support rest of this invention.

In the second embodiment which is illustrated in FIG. 4, the neck support rest is essentially the same as the first embodiment except that ridge 11 is contoured at its upper rear portion 18 by a chamfered slope 26. Walls 14*a* and 14*c* of base 10 are eleven inches (11") wide and three inches (3") high, wall 14b of base 10 is twenty-one and one half inches (21½) wide and three inches (3") high and wall 14d of base 10 is three inches (3") high and has a curvature with a radius of twenty-five inches (25"). Rear arched wall 22 and front arched wall 21 of ridge 11 have curvatures of the same radius as wall 14*d* of base 10. Side walls 19 and 20 each have a width of four inches (4") along edge 27, a height of three inches (3") along edge 28, a width of two inches (2") along edge 29, a length of two inches (2") along edge 30 and a height of two inches (2") along edge 31.

Ridge 11 protrudes lengthwise over the front portion of base 10 such that a one inch band 32 of the front portion 17 of ridge 11 overhangs the front portion 13 of base 10. Recess 25 is defined by wall **14*d* and band 32**.

Figure 5:
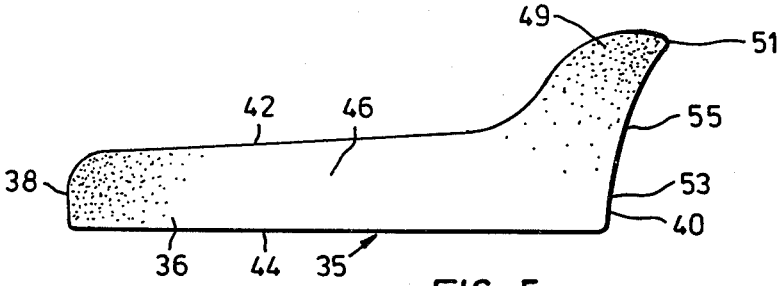
FIG. 5 is a elevational view of the third embodiment of this invention.
Figure 6:
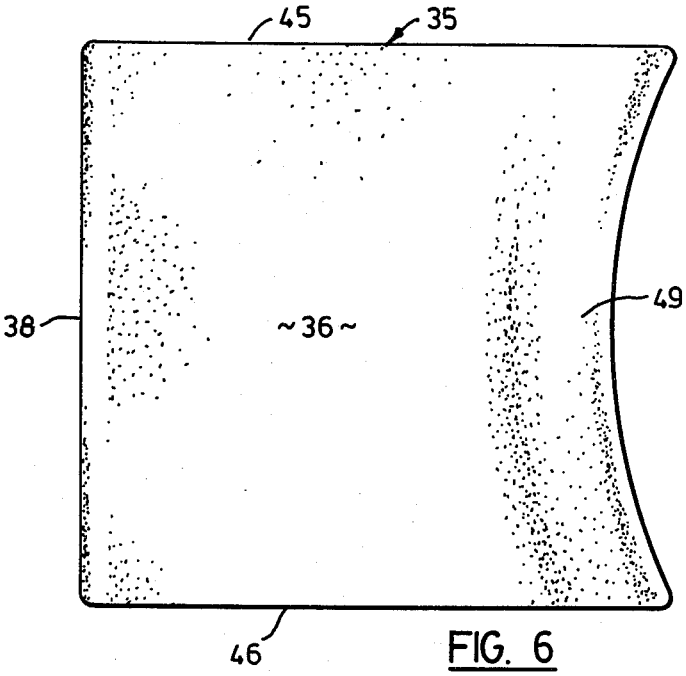
FIG. 6 is a plan view of the third embodiment of this invention.
Figure 7:
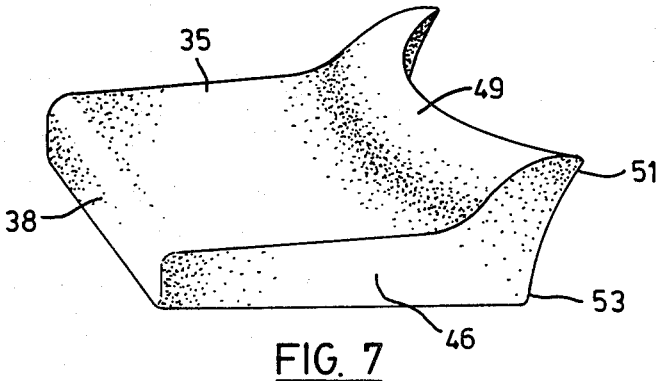
FIG. 7 is a perspective view of the third embodiment of this invention.

Attention is now directed to FIGS. 5–7, which illustrate a support rest 35 in the form of a unitary body of resilient material, the body having a base portion 36 with a rear edge 38, a front edge 40, a top surface 42, a bottom surface 44, and two side edges 45 and 46. The unitary body includes an upstanding ridge 49 along the front edge, configured in such a way that the top 51 of the ridge 49 forwardly overhangs the bottom 53 of the ridge.

More specifically, the front edge 40 of the base portion 36 slopes forwardly and upwardly to the top 51 of the ridge, the profile of said forward and upward slope being slightly concave when seen in vertical section or vertical elevation. FIG. 5 shows a vertical elevation, and the concave profile 55 can be clearly seen.

Seen from the top in plan view (see FIG. 6), the unitary body exhibits a concave curvature along the front edge of the ridge 49, and the front edge 40 generally follows the same concave curvature. Preferably, the radius of curvature of the front edge 40 of the base portion 36 is of the same order as the typical distance from the waist region to the top of the head of an adult. Typically this distance may be on the order of twenty-five inches (25").

As best seen in FIGS. 5 and 7, the rear of the ridge 49 merges smoothly with the top surface 42 of the base portion 36, with the profile of the combined ridge 49 and surface 42 being S-shaped. This is best seen in FIG. 5.

It will thus be seen that, due to the forward oblique overhang of the ridge 49 with respect to the base portion 36, there is provided an inherent flexiblility in the ridge 49, which allows it to descend to some extent under pressure, in cases where the user lies in an unusual position, or where the user has particularly small shoulders. At the same time, by having the ridge 49 forwardly obliquely projecting with respect to the base portion 36, it will be understood that downward pressure on the ridge 49 will tend to move the ridge 49 not only downwardly but forwardly (i.e. to the right in FIG. 5). This will produce a traction effect on the person lying with the neck supported by the ridge 49 and the head on the surface 42 of the base portion 36. For a majority of individuals who experience tenseness and contraction in the neck and lower head region, such stretching tendency in the item disclosed herein is of considerable benefit.

In the embodiment shown in FIGS. 5–7, as with the earlier embodiments, the forward oblique projection of the ridge portion allows the user's shoulder to be tucked in under the overhang, when lying on the side, thus producing an added degree of comfort.

It will be understood that the support rest disclosed herein can be made from a variety of materials, provided these are resilient to the required degree. Such materials may include foam or sponge rubber, and the dimensions of the unit may vary to suit the size of the adult or child for which the device is intended. The particular dimensions set out in the description of the second embodiment have been offered for clarification only.

It will further be understood that the degree of arch of the walls **14*d*, 21, 22, and 40 can vary, and that the arch of any of these walls need not correspond to the arch on the other wall or walls. It will be further understood that the size of the recess 25** can vary.

In FIG. 3, a variant structure is represented by a wedge component 35, having side walls 36, a convex upper wall 38, a concave cylindrical front wall 40 and a flat bottom wall 41. The wedge component 35 is adapted to fit against the surface 15 and rear wall 22, to provide a smooth, oblique surface rearwardly of the upper ridge 11.

For the embodiment shown in FIGS. 5–7, it is contemplated that the item be made as a unitary body of foamed resilient material, and that the outer skin of the unitary body be denser and hence of higher strength than the interior portion thereof. This will allow a considerable degree of resilience due to the less dense interior structure of the item, but will allow the item to resist tearing or ripping under stress, due to the greater strength of the more denser skin.

We claim:

1. A neck support rest comprising a unitary body of resilient material, the body having a base portion with top and bottom surfaces, a rear edge and a front edge, and an upstanding ridge along the said front edge, the top of the ridge projecting forwardly with respect to the bottom of the front edge of the body in order to ensure that the ridge can tuck into and hence support the lower neck region of a person lying on his side with his head on the base portion, the front edge of the base portion merging smoothly into the ridge, to define a forwardly and upwardly sloping profile, the forwardly projecting top of the ridge tending to deform downwardly and forwardly under the imposition of downward pressure thereon.

2. The neck support rest claimed in claim 1, in which the said front edge of the base portion has a concave curvature when seen in plan, and in which the ridge has a similar curvature.

3. The neck support rest claimed in claim 2, in which the radius of curvature of said concavely curved front edge is of the same order as the typical distance from the waist region to the top of the head of an adult.

4. The neck support rest claimed in claim 1 or claim 2, in which the ridge is rounded on top.

5. The neck support rest claimed in claim 1, in which the resilient material is foamed, and in which the outer skin of the unitary body is denser and hence of higher strength than the interior portion thereof.

* * * * *